US007520580B2

(12) United States Patent
Iriguchi

(10) Patent No.: US 7,520,580 B2
(45) Date of Patent: Apr. 21, 2009

(54) DEVICE AND METHOD FOR EJECTING INK DROPLET

(75) Inventor: Akira Iriguchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 491 days.

(21) Appl. No.: 11/358,041

(22) Filed: Feb. 22, 2006

(65) Prior Publication Data

US 2006/0187275 A1 Aug. 24, 2006

(30) Foreign Application Priority Data

Feb. 22, 2005 (JP) ..... 2005-045505

(51) Int. Cl.
*B41J 29/38* (2006.01)
*B41J 2/045* (2006.01)

(52) U.S. Cl. ..... 347/11; 347/71

(58) Field of Classification Search ..... 347/9, 347/11, 68, 70–72
See application file for complete search history.

(56) References Cited

U.S. PATENT DOCUMENTS 5,402,159 A 3/1995 Takahashi et al.
6,431,674 B2 * 8/2002 Suzuki et al. ..... 347/10
6,663,208 B2 12/2003 Suzuki et al.
6,840,595 B2 * 1/2005 Kusunoki ..... 347/10

FOREIGN PATENT DOCUMENTS

JP 4341853 11/1992
JP 952357 2/1997
JP 2002160362 6/2002

* cited by examiner

*Primary Examiner*—An H Do
(74) *Attorney, Agent, or Firm*—Baker Botts L.L.P.

(57) ABSTRACT

An ink droplet ejection device including: (a) actuators each operable to apply an ejection pressure to an ink stored in a corresponding pressure chamber, for causing an ink ejection through a corresponding nozzle, whereby an image formed as a result of the ink ejection is produced on a medium; and (b) a controller operable to supply a control signal to each actuator, and incorporating a drive pulse train into the control signal for causing ejection of at least two cooperative ink droplets that cooperate to form one dot of the image. The drive pulse train includes at least two drive pulses. One of the at least two drive pulses has a first pulse width smaller than a maximizing value that maximizes an ejection velocity and a volume of each ink droplet to be ejected. Another one of the at least two drive pulses has a second pulse width larger than the maximizing value. Also disclosed a method of producing the image on the medium by using the ink droplet ejection device.

17 Claims, 10 Drawing Sheets

FIG.7A
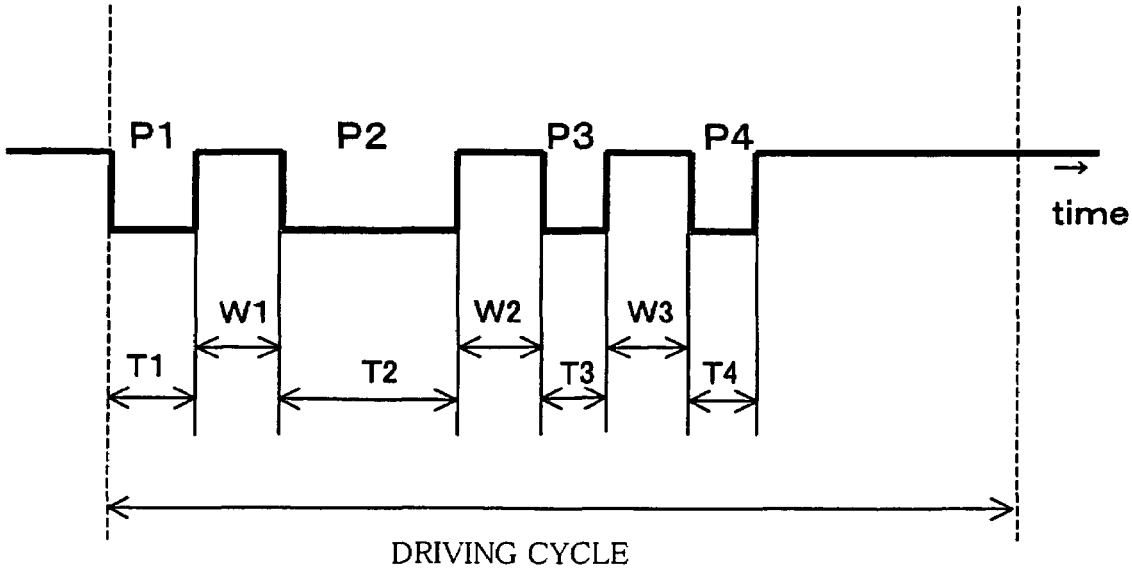
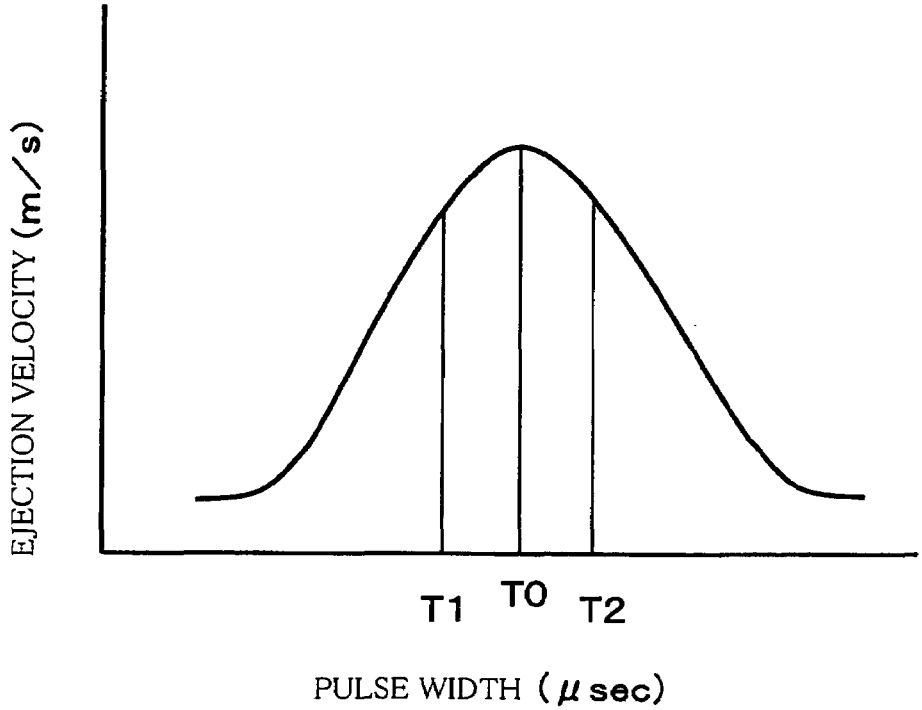
FIG.7B

FIG.9A

| | No. | PULSE WIDTH OR SEPARATION(μ sec) | | | | | | | SATELLITE PREVENTION | EJECTION STABILITY | EJECTION CAPACITY | DOT SIZE UNIFORMITY |
|---|---|---|---|---|---|---|---|---|---|---|---|---|
| | | T1 | W1 | T2 | W2 | T3 | W3 | T4 | | | | |
| | 1 | 3 | 4 | 8 | 4 | 3 | 4 | 3 | ○ | ○ | △ | ○ |
| * | 2 | 4 | 4 | 8 | 4 | 3 | 4 | 3 | ○ | ○ | ○ | ○ |
| | 3 | 5 | 4 | 8 | 4 | 3 | 4 | 3 | ○ | △ | ○ | ○ |
| | 4 | 4 | 3 | 8 | 4 | 3 | 4 | 3 | ○ | ○ | △ | ○ |
| | 5 | 4 | 5 | 8 | 4 | 3 | 4 | 3 | ○ | △ | ○ | ○ |
| | 6 | 4 | 4 | 7 | 4 | 3 | 4 | 3 | ○ | △ | ○ | ○ |
| | 7 | 4 | 4 | 9 | 4 | 3 | 4 | 3 | ○ | △ | ○ | ○ |
| | 8 | 4 | 4 | 8 | 3 | 3 | 4 | 3 | △ | ○ | ○ | ○ |
| * | 9 | 4 | 4 | 8 | 5 | 3 | 4 | 3 | ○ | ○ | ○ | ○ |
| | 10 | 4 | 4 | 8 | 4 | 3 | 4 | 3 | △ | ○ | △ | ○ |
| | 11 | 4 | 4 | 8 | 4 | 2 | 4 | 3 | △ | ○ | ○ | ○ |
| | 12 | 4 | 4 | 8 | 4 | 4 | 3 | 3 | ○ | ○ | △ | ○ |
| | 13 | 4 | 4 | 8 | 4 | 3 | 5 | 3 | △ | △ | ○ | ○ |
| | 14 | 4 | 4 | 8 | 4 | 3 | 4 | 2.5 | ○ | △ | ○ | ○ |
| | 15 | 4 | 4 | 8 | 4 | 3 | 4 | 2.5 | △ | △ | ○ | ○ |

| No. | PULSE WIDTH OR SEPARATION(μ sec) | | | | | | | SATELLITE PREVENTION | EJECTION STABILITY | EJECTION CAPACITY | DOT SIZE UNIFORMITY |
|---|---|---|---|---|---|---|---|---|---|---|---|
| | T1 | W1 | T2 | W2 | T3 | W3 | T4 | | | | |
| 21 | 4.5 | 4.5 | 4.5 | 4.5 | 4.5 | 6 | 2.5 | ○ | ○ | △ | △ |
| 22 | 5 | 5 | 5 | 5 | 5 | 6 | 2.5 | △ | ○ | ○ | △ |
| 23 | 5.5 | 5.5 | 5.5 | 5.5 | 5.5 | 6 | 2.5 | △ | × | ○ | △ |
| 24 | 5 | 5 | 5 | 5 | 5 | 5 | 2.5 | ○ | △ | ○ | △ |
| 25 | 5 | 5 | 5 | 5 | 5 | 7 | 2.5 | △ | △ | ○ | △ |
| 26 | 5 | 5 | 5 | 5 | 5 | 6 | 2 | △ | ○ | ○ | △ |
| 27 | 5 | 5 | 5 | 5 | 5 | 6 | 3 | △ | △ | ○ | △ |

FIG.9B

DEVICE AND METHOD FOR EJECTING INK DROPLET

This application is based on Japanese Patent Application No. 2005-045505 filed in Feb. 22, 2005, the content of which is incorporated hereinto by reference.

BACKGROUND OF THE INVENTION

1. Field of the Invention

The present invention relates to an ink droplet ejection device and an ink droplet ejection method.

2. Discussion of Related Art

As an ink droplet ejection device, there is known a recording head that is to be incorporated in an inkjet printer. U.S. Pat. No. 6,663,208 (corresponding to JP-2002-160362A) discloses such a recording head including: (a) a cavity unit having (a-1) a plurality of nozzles located in its front portion and (a-2) a plurality of pressure chambers located in its rear portion and held in communication with the respective nozzles; and (b) a piezoelectric actuator unit fixedly disposed on the rear portion of the cavity unit. The piezoelectric actuator unit includes a plurality of deformable portions serving as actuators. Each of the deformable portions is arranged to be deformable with application of a drive pulse signal (voltage) thereto so as to change a volume of a corresponding one of the pressure chambers and apply an ejection pressure to an ink stored in the corresponding pressure chamber, so that the ink is ejected from the corresponding pressure chamber through one of the nozzles that is held in communication with the corresponding pressure chamber. The ejected ink takes a form of an ink droplet that is received in a recording medium, whereby an ink dot is formed on the recording medium. The recording head is arranged to be reciprocably movable in a main scanning direction (i.e., a width direction of the recording medium) that is perpendicular to a sub-scanning direction (i.e., a feeding direction of the recording medium).

It is common that an inkjet printer has a plurality of recording modes which are different with respect to size and density of the ink dot that is to be formed on the recording medium. Depending upon a selected one of the recording modes, the movement velocity of the recording head and the number of ink droplet or droplets constituting the ink dot are changed.

As discussed in the above-identified U.S. Pat. No. 6,663,208, upon ejection of the ink droplets, there is a case where extra droplets called "satellite" are ejected in addition to main droplets. The satellite droplets could be caused, for example, where a plurality of ink droplets are successively ejected so as to cooperate with each other to form the ink dot. The successive ejections of the plurality of ink droplets are made by pressure fluctuation caused in the corresponding pressure chamber. Such pressure fluctuation, in general, cannot be sufficiently terminated upon completion of the successive ejection, so that extra droplets are inevitably ejected as the satellite droplets, due to the pressure fluctuation remaining in the corresponding pressure chamber even after the completion of the successive ejection. That is, the satellite droplets are caused principally by the residual pressure fluctuation. If the satellite droplets are received by the recording medium, it is not possible to obtain a recorded image as desired, resulting in deterioration in the recording quality.

The satellite droplets are not likely to be caused in an operation with a recording mode for a high image resolution in which a recording operation is performed by small-sized dots each formed of a small-sized ink droplet with the recording head being moved at a relatively low speed. On the other hand, the satellite droplets are likely to be caused in an operation with a recording mode for a low image resolution in which a recording operation is performed by large-sized dots each formed of a plurality of ink droplets for reducing a length of time to complete the recording over a certain unit of area. That is, for forming each dot with a plurality of ink droplets, a plurality of successive drive pulses are applied to the corresponding actuator in a short length of time. Pressure waves generated by the successive drive pulses remain in the ink stored in the corresponding pressure chamber even after the ink ejection performed by a final one of the successive drive pulses, and the remaining pressure waves cause undesirable ejection of the satellite droplets.

In view of the above problem, the present inventor has studied to obtain a waveform of pulse train effective to avoid occurrence of the satellite droplets even in the low resolution mode in which each ink dot is required to have a large size. The study was conducted with assumption that the recording operation is to be performed with a recording mode for a low image resolution, specifically, with an image resolution of about 600 dpi×600 dpi (dot per inch). In this low resolution mode, it is considered, by taking account of a volume of each one droplet in a standard resolution mode, that each one dot requires to be constituted by about three droplets.

In an inkjet head, commonly, an ejection velocity of each ink droplet is changed depending upon a pulse width of the drive pulse. The relationship between the ejection velocity and the pulse width is represented by a curved line that is convex upward, as shown in a graph of FIG. 10A. In this graph, where the pulse width of the drive pulse is set at a value T0, the ejection velocity is peaked or maximized. Since the ink droplet is ejected most efficiently with the pulse width being set at the value T0, not only the ejection velocity but also a volume of the ejected ink droplet is peaked or maximized at the value T0.

The present inventor has tested a drive pulse train, as shown in FIG. 10B, including (a) three successive drive pulses each having a pulse width that is set at the above-described maximizing value T0, for causing successive ejection of three ink droplets (i.e., ejection of the ink of amount that is three times as large as an ordinary amount) and (b) one complementary drive pulse (canceling signal) for canceling residual pressure waves that have been generated by the preceding three successive drive pulses. The complementary drive pulse has a pulse width that is small so as not to cause ejection of another ink droplet. The pulse widths of the three successive drive pulses and the complementary drive pulse are respectively set to cooperate to satisfy the following expressions:

$$T1=T2=T3=T0,$$

T4<<T0, where "T0" represents the maximizing value; "T1" represents the pulse width of a first one P1 of the three successive drive pulses; "T2" represents the pulse width of a second one P2 of the three successive drive pulses; "T3" represents the pulse width of a third one P3 of the three successive drive pulses; and "T4" represents the pulse width of the complementary drive pulse P4 following the three successive drive pulses.

The test revealed that the ejection of the satellite droplets can not be satisfactorily prevented in the above-described drive pulse train (as shown in FIG. 10B). That is, the ejection of the satellite droplets can not be sufficiently prevented only by the complementary drive pulse P4 provided after the three successive drive pulses P1, P2, P3 and serving as the canceling signal. It might be possible to satisfactorily cancel the residual pressure waves, for example, by adding another complementary drive pulse serving as another canceling signal in the drive pulse train. However, the increase in the number of the drive pulses in a drive cycle for covering one dot affects a drive cycle for covering the subsequent dot. In this sense, the increase in the number of the drive pulses is not feasible.

Further, there is another problem originating from difficulty in equally manufacturing a large number of recording heads without variation among the individual recording heads. That is, even among the recording heads of the same specification, there could be some difference in characteristic or performance for ink ejection. The recording heads could be different from one another with respect to the relationship, too, which is represented by the curved line in the graph of FIG. 10A. Consequently, the volume of the ejected ink droplet at the above-described maximizing vale T0 is not necessarily the same in all of the recording heads, but could vary from one to another. Particularly, where a recording operation is performed by large-sized dots each formed of a plurality of (e.g., three) ink droplets ejected with the pulse width of the maximizing vale T0, as described above, the variation in volume between the ink droplets leads to a variation in size between the dots. The variation in size of the dots is a plurality of times (e.g., three times) as large as the variation in volume between the ink droplets, and accordingly is too large to ignore.

SUMMARY OF THE INVENTION

It is therefore a first object of the invention to provide an ink droplet ejection device capable of forming dots of an image produced on a medium without suffering variation in size between the dots and/or forming large-sized dots of an image produced on a medium without occurrence of satellite droplets. It is a second object of the invention is to provide a method of producing an image on a medium, by using the ink droplet ejection device. The first object may be achieved according to any one of first through fourth aspects of the invention that are described below. The second object may be achieved according to a fifth aspect of the invention that is described below.

The first aspect of the invention provides an ink droplet ejection device including: (a) a plurality of nozzles; (b) a plurality of pressure chambers held in communication with the respective nozzles; (c) a plurality of actuators each operable to apply an ejection pressure to an ink stored in a corresponding one of the pressure chambers, for causing an ink ejection from the corresponding one of the pressure chambers through one of the nozzles that is held in communication with the corresponding pressure chamber, whereby an image formed as a result of the ink ejection is produced on a medium; and (d) a controller operable to supply a control signal to each of the plurality of actuators, and incorporating a drive pulse train into the control signal for causing ejection of at least two cooperative ink droplets that cooperate with each other to form one dot of the image produced on the medium. The drive pulse train includes at least two drive pulses. One of the at least two drive pulses having a first pulse width smaller than a maximizing value that maximizes an ejection velocity and a volume of each ink droplet to be ejected. Another one of the at least two drive pulses having a second pulse width larger than the maximizing value. It is noted that the maximizing value may be referred also to as a peak-value establishing value that causes the ejection velocity and the volume of each ejected ink droplet to be peaked.

According to the second aspect of the invention, in the ink droplet ejection device in the first aspect of the invention, the drive pulse train includes, in addition to the at least two drive pulses as at least two main drive pulses, at least one complementary drive pulse following the at last two main drive pulses, for causing ejection of the at least two cooperative ink droplets in the form of at least two main ink droplets and at least one complementary ink droplet each of which has a volume smaller than a volume of each of the at least two main ink droplets.

According to the third aspect of the invention, in the ink droplet ejection device in the second aspect of the invention, each of the at least one complementary drive pulse has a pulse width that is adjusted to cause the volume of each of the at least one complementary ink droplet to be smaller than the volume of each of the at least two main ink droplets and to cancel residual pressure waves generated by the at least two main drive pulses.

The fourth aspect of the invention provides an ink droplet ejection device including: (a) a plurality of nozzles; (b) a plurality of pressure chambers held in communication with the respective nozzles; (c) a plurality of actuators each operable to apply an ejection pressure to an ink stored in a corresponding one of the pressure chambers, for causing an ink ejection from the corresponding one of the pressure chambers through one of the nozzles that is held in communication with the corresponding pressure chamber, whereby an image formed as a result of the ink ejection is produced on a medium; and (d) a controller operable to supply a control signal to each of the plurality of actuators, and incorporating a drive pulse train into the control signal for causing ejection of at least one ink droplet that forms one dot of the image produced on the medium. The drive pulse train includes at least one main drive pulse and at least one complementary drive pulse following the at least one main drive pulse, for causing ejection of the at least one ink droplet in the form of at least one main ink droplet and at least one complementary ink droplet each of which has a volume smaller than a volume of each of the at least one main ink droplet. Each of the at least one complementary drive pulse has a pulse width that is adjusted to cause the volume of each of the at least one complementary ink droplet to be smaller than the volume of each of the at least one main ink droplet and to cancel a residual pressure wave generated by each of the at least one main drive pulse.

The fifth aspect of the invention provides a method of producing an image on a medium by using the ink droplet ejection device defined in the third aspect of the invention. The method includes incorporating the drive pulse train including the at least two main drive pulses and the at least one complementary drive pulse, into the control signal supplied to each of the plurality of actuators, for causing the ejection of the two main ink droplets and the at least one complementary ink droplet that cooperate to form the one dot of the image produced on the medium.

In the ink droplet ejection device or the image producing method defined in any one of the first through third and fifth aspects of the invention, one of the at least two drive pulses has the first pulse width that is smaller than the maximizing value, while another one of the at least two drive pulses has the second pulse width that is larger than the maximizing value. That is, the above-described one and another one of the at least two drive pulses have the first and second pulse widths that are different from each other with respect to sense of their deviation from the maximizing value.

It is common that there is difference between the plurality of ink droplet ejection devices and/or nozzles with respect to characteristic of ink ejection. Such a difference is likely to cause variation in the ejection velocity and the volume of the ejected ink droplet at the maximizing value and/or variation in the maximizing value as such. However, even if there is a variation in the maximizing value, a total volume of ink droplets ejected by the above-described one and another one of the at least two drive pulses can be held substantially constant, as long as the maximizing value lies between the first and second pulse width values. This is because, where the actually maximizing value is deviated from its nominal value toward the first pulse width, the amount of the ink droplet ejected by the one of the at least two drive pulses is made larger than its expected value, while the amount of the ink droplet ejected by the another of the at least two drive pulses is made smaller than its expected value, so that the amounts of the ink droplets ejected by the one and another one of the at least two drive pulses are offset by each other. Thus, this arrangement is effective to reduce influence of the difference in the ink ejection characteristic and to stabilize a total amount of the at least two cooperative ink droplets that cooperate with each other to form one dot of the produced image. It is noted that the above-describe one and another of the at least two drive pulses do not have to be successively arranged in the drive pulse train, but may be arranged with a still another one of the at least two drive pulses being interposed therebetween. It is further noted that the one and another of the at least two drive pulses do not have to be arranged in this order in the drive pulse. Either one of the one and another of the at least two drive pulses may precede the other.

In the ink droplet ejection device defined in the second aspect of the invention, the drive pulse train includes the at least two main drive pulses and at least one complementary drive pulse following the at least two main drive pulses, such that the at least two main ink droplets and at least one complementary ink droplet are ejected. Since the at least two main drive pulses include drive pulses having the first and second pulse widths that are deviated from the maximizing value, it is likely to exist a difference between a total volume of the at least two main ink droplets and a volume required to form the one dot of the image. In this sense, the at least one complementary ink droplet preferably is adapted to have a total volume that is substantially equal to such a difference between the total volume of the at least two main ink droplets and the volume required to form the one dot of the image.

In the ink droplet ejection device defined in each of the third and fourth aspects of the invention, the pulse width of each of the at least one complementary drive pulse is adjusted to cause the volume of each of the at least one complementary ink droplet to be smaller than the volume of each of the main ink droplet or droplets and to cancel residual pressure wave or waves generated by the main drive pulse or pulses. Thus, each of the at least one complementary drive pulse serves not only to cause ejection of the at least one complementary ink droplet each having the relatively small volume, but also to cancel the residual pressure wave or waves for preventing occurrence of satellite droplets.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which:

FIG. 7A is a view showing a waveform of a pulse train for causing successive ejection of a plurality of ink droplets that cooperate to form one of an image;

FIG. 7B is indicating pulse width values T1, T2 of main drive pulses in a graph showing a relationship between a pulse width of a drive pulse and a velocity of ink droplet ejected by the drive pulse;

FIG. 9A is a table showing a result in an experiment conducted with application of each of drive pulse trains having respective different waveforms configured according to the invention;

FIG. 9B is a table showing a result in an experiment conducted with application of each of drive pulse trains having conventional waveforms;

DETAILED DESCRIPTION OF THE PREFERRED EMBODIMENT

Figure 1:
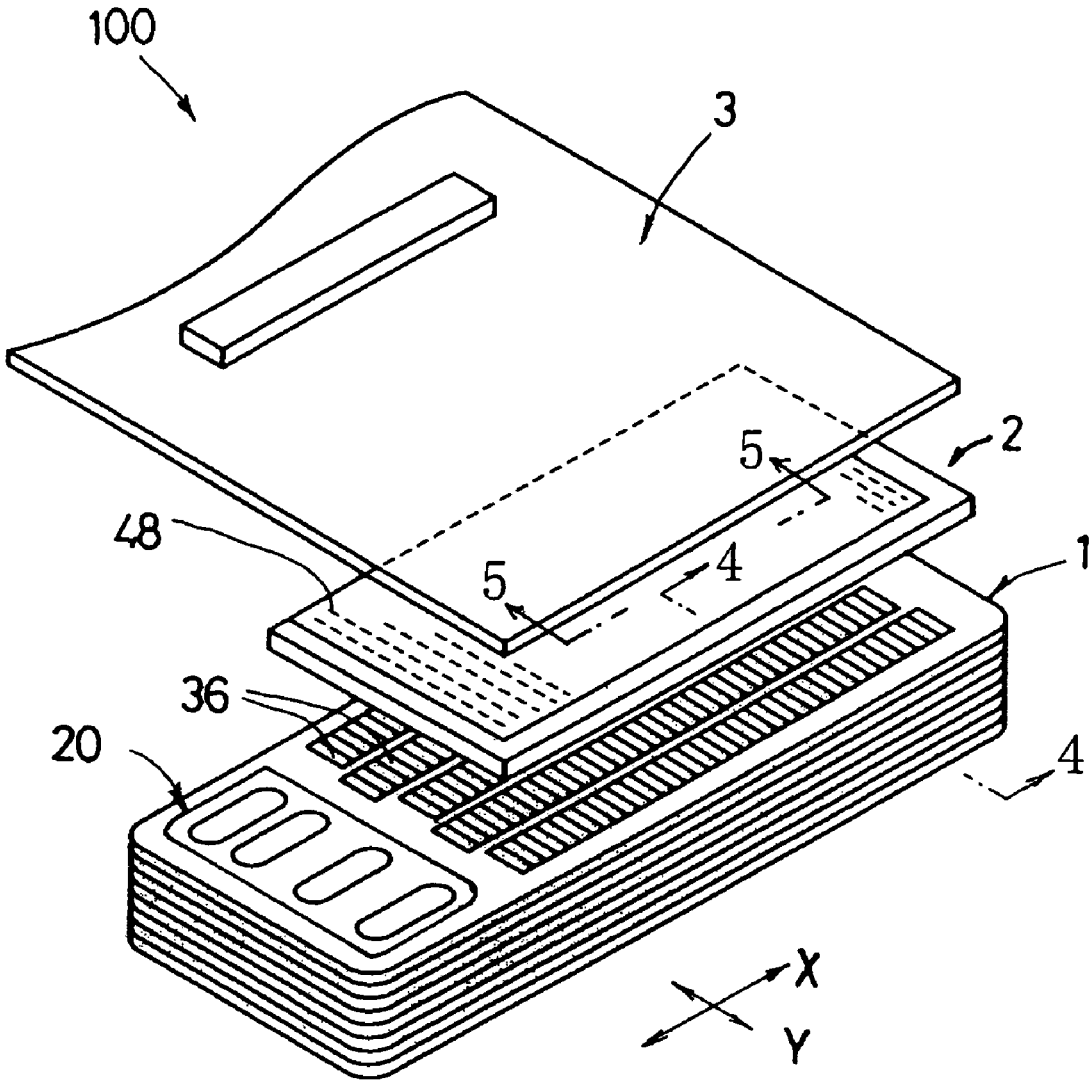
FIG. 1 is a perspective and exploded view showing an inkjet head constructed according to an embodiment of the invention.

The present invention is applicable to an ink droplet ejection device such as a recording head (hereinafter referred to as "inkjet head") 100, as shown in FIG. 1, which is constructed according to the invention. This inkjet head 100 is to be mounted on a carriage (not shown) of an inkjet printer, which is arranged to be reciprocably movable in a main scanning direction that is perpendicular to a sub-scanning direction in which a recording medium is to be fed. The inkjet printer is equipped with ink cartages (not shown) that are removably mounted on the carriage or disposed on a stationary portion of the printer, such that each of inks of four colors (e.g., black, cyan, yellow and magenta) stored in the respective ink cartridges can be supplied directly or through supplying pipes to the inkjet head 100. It is noted that, in the following description, the main scanning direction is referred also to as "second direction" or "X direction" while the sub-scanning direction is referred also to as "first direction" or "Y direction".

As shown in FIG. 1, the inkjet head 100 includes a cavity unit 1 provided by a plurality of metal plates, and a plate-shaped piezoelectric actuator unit 2 fixedly superposed on the cavity unit 1. A flexible flat cable 3 for connection with an external device is superposed on and bonded to an upper surface of the piezoelectric actuator unit 2 (see FIG. 4). The cavity unit 1 has a lower surface (front surface) in which a multiplicity of nozzles 4 are open, so that an ink droplet is downwardly ejected through the nozzles 4.

Figure 2:
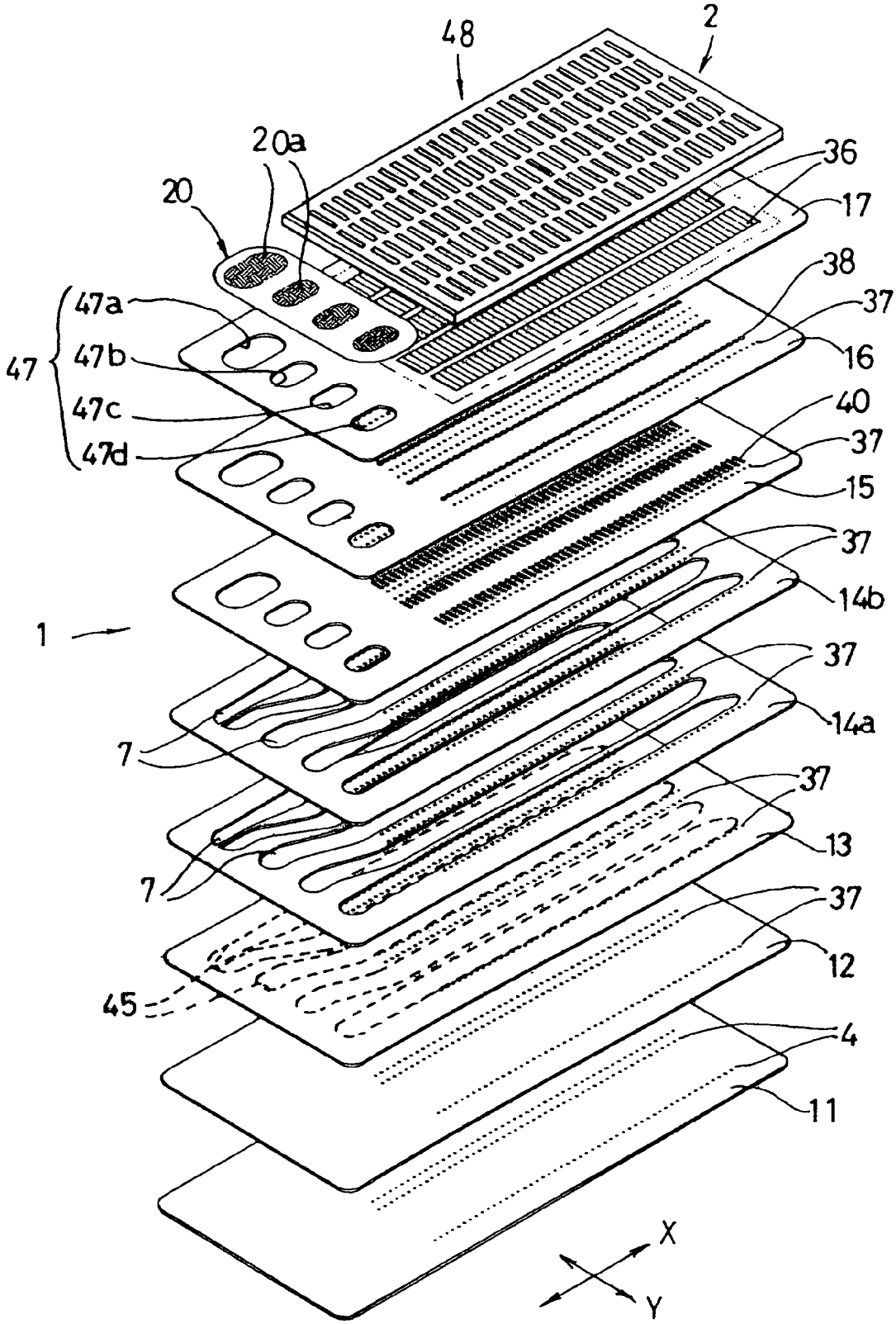
FIG. 2 is a perspective and exploded view showing a cavity unit and an actuator unit of the inkjet head of FIG. 1.

As shown in FIG. 2, the cavity unit 1 is a laminar structure consisting of a total of eight thin plates superposed on each other in a vertical direction of the inkjet head 100 and bonded together by an adhesive. The eight thin plates consist of a nozzle plate 11, a spacer plate 12, a damper plate 13, two manifold plates 14X, 14Y, a supply plate 15, a base plate 16 and a cavity plate 17.

In the present embodiment, each of the plates 11-17 has a thickness of about 50-150μm. The nozzle plate (lowermost plate) 11 is formed of a synthetic resin such as polyamide, while each of the other plates 12-17 is formed of a steel alloy containing 42% of nickel. Each of the nozzles 4, formed through the nozzle plate 11, has an extremely small diameter (about 25 μm in this embodiment). The nozzles 4 are arranged at a predetermined small pitch in five parallel rows extending in the X direction (i.e., in a longitudinal direction of the nozzle plate 11).

Figure 3:
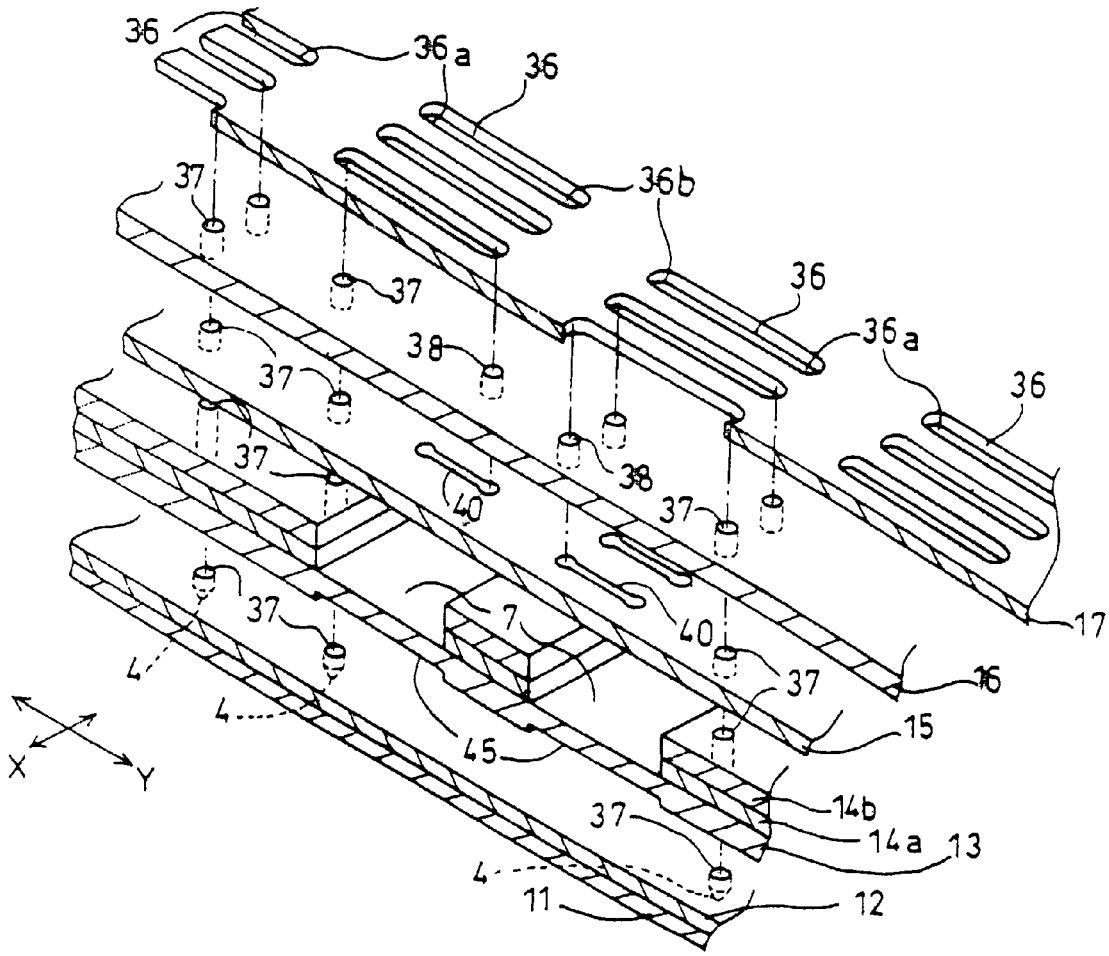
FIG. 3 is a perspective and exploded view in enlargement showing a part of the cavity unit of FIG. 2.

In the cavity plate (uppermost plates) 17, a multiplicity of pressure chambers 36 are formed to be arranged in five parallel rows extending in the above-described X direction, as shown in FIG. 3. In the present embodiment, each of the pressure chambers 36 is elongated in the Y direction (i.e., in a width direction of the cavity plate 17). Each elongated pressure chamber 36 is held in communication at its longitudinal end portion 36*a* with the corresponding nozzle 4, and is held in communication at another longitudinal end portion 36*b* with a common chamber (manifold chamber) 7.

The pressure chambers 36 are held in communication at the respective longitudinal end portions 36*a* with the respective nozzles 4 via respective ink delivery passage in the form of communication holes 37 which have an extremely small diameter and which are formed through the base plate 16, supply plate 15, two manifold plates 14*a*, 14*b*, damper plate 13 and spacer plate 12.

The base plate 16, which is held in contact with a lower surface of the cavity plate 17, has through-holes 38 formed therethrough and connected to the longitudinal end portions 36*b* of the respective pressure chambers 36.

The supply plate 15, which is held in contact with a lower surface of the base plate 16, defines horizontally extending connection passages 40 through which the ink is supplied from the common chamber 7 to the respective pressure chambers 36. Each of the connection passages 40 has an inlet portion through which the ink flows from the common chamber 7, and an outlet portion which opens in the corresponding through-hole 38 connected to the corresponding pressure chamber 36. Each connection passage 40 has a flow restrictor portion which is located between the inlet and outlet portions, and a cross sectional area which is made relatively small in the flow restrictor portion for applying a resistance to flow of the ink.

The two manifold plates 14*a*, 14*b* cooperate to partially define five common chambers 7 which are formed through the entire thickness of each of the two manifold plates 14*a*, 14*b*. The five common chambers 7 are elongated in the above-described X direction, so as to extend along the respective rows of the nozzles 4 which also extend in the X direction. The five common chambers 7 are defined by the two manifold plates 14*a*, 14*b* superposed on each other, the supply plate 15 superposed on an upper surface of the manifold plate 14*b*, and the damper plate 13 underlying a lower surface of the manifold plate 14*a*. Each common chamber 7 is elongated in a direction substantially parallel with the rows of the pressure chambers 36 (the rows of the nozzles 4), and has a portion which overlaps the pressure chambers 36 arranged in a corresponding one of the rows, as seen in the plan view, i.e., as viewed in the vertical direction in which the eight thin plates 11-17 are superposed on each other.

Figure 4:
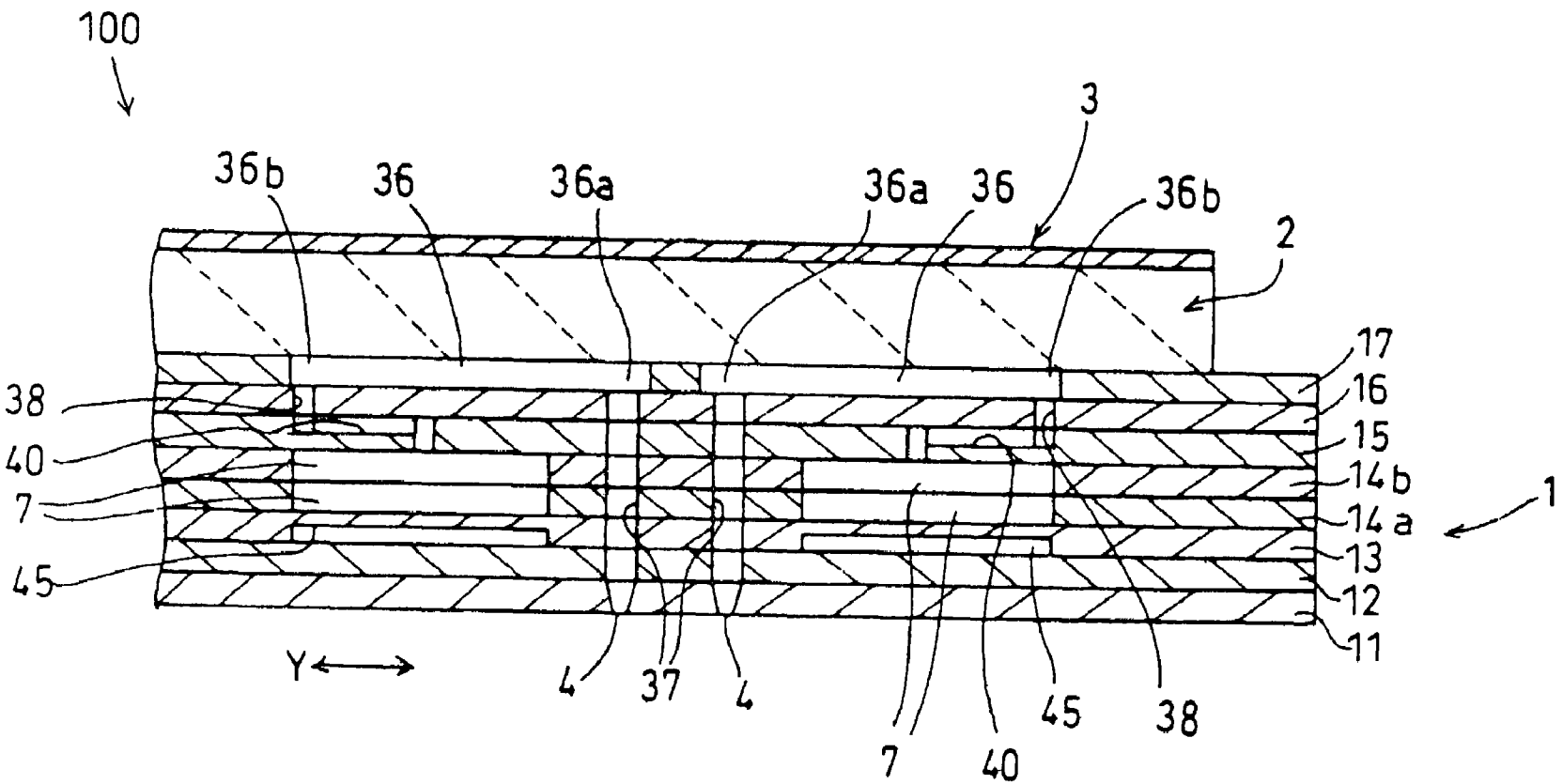
FIG. 4 is a cross sectional view taken along line 4-4 of FIG. 1.

The damper plate 13, which is held in contact with a lower surface of the manifold plate 14*a*, has five damper chambers 45 which are provided by recesses formed on a lower surface of the damper plate 13, such that the damper chambers 45 are isolated from the common chambers 7, as shown in FIGS. 3 and 4. Each damper chamber 45 is positioned and configured to overlap with the corresponding common chamber 7, as seen in the plan view. Since the damper plate 13 is provided by a metallic material that is suitably deformable in an elastic manner, its thin-walled ceiling portion defining an upper end of each damper chamber 45 is freely oscillable either upward or downward, namely, either toward the common chamber 7 or toward the damper chamber 45. Therefore, even if a pressure fluctuation generated in one of the pressure chambers 36 upon an ink ejection from the one of the pressure chambers 36 is propagated to the corresponding common chamber 7, the propagated pressure fluctuation can be absorbed or damped by oscillation of the elastically deformed ceiling portion. Thus, the damper plate 13 having the elastically deformable ceiling portion provides a damping effect preventing propagation of the pressure fluctuation from the one of the pressure chambers 36 to the other pressure chambers 36, namely, preventing a cross talk between the adjacent pressure chambers 36.

Each of the supply plate 15, base plate 16 and cavity plate 17 has four through-holes located in one of its longitudinal end portions, such that the four through-holes of each of the plates 15-17 are aligned with those of the other of the plates 15-17 in the vertical direction. Thus, the plates 15-17 cooperate to define four ink inlets 47 each of which is held in communication with one of opposite end portions of a corresponding one of the common chambers 7. In the following description, a leftmost one, a second leftmost one, a second rightmost one and a rightmost one of the four ink inlets 47 (as seen in FIG. 2) will be referred to as the ink inlets 47*a*, 47*b*, 47*c* and 47*d*, respectively.

The ink is supplied to the common chambers 7 through the respective ink inlets 47, and is then distributed into the pressure chambers 36 via the connection passages 40 of the supply plate 15 and the through-holes 38 of the base plate 16 (see FIG. 3). The ink stored in each of the pressure chambers 36 is caused by activation of a corresponding one of actuators of the actuator unit 2, to be delivered to the corresponding nozzles 4 via the corresponding through-hole 37. With application of an ejection pressure to the ink stored in the pressure chamber 36, a pressure wave is generated in the pressure chamber 35 and is transmitted via the corresponding through-hole 37 to the corresponding nozzle 4, whereby the ink delivered to the nozzle 4 is ejected toward the recording medium.

In the present embodiment, in which the number of the ink inlets 47 is four while the number of the common chambers 7 is five (see FIG. 2), the ink inlet 47*a* assigned to the black ink (BK) is held in communication with two of the five common chambers 7 (which are the leftmost two of the five common chambers 7 as seen in FIG. 2), rather than with only one of the five common chambers 7. This arrangement is based on a fact that the black ink (BK) tends to be consumed more than the other color inks. Each of the other ink inlets 47*b*, 47*c*, 47*d* respectively assigned to the cyan ink (C), yellow ink (Y) and magenta ink (M) is held in communication with a corresponding one of the common chambers 7. A cover plate 20 is bonded to a portion of the upper surface of the cavity plate 17 in which the ink inlets 47*a*, 47*b*, 47*a*, 47*d* open, such that filter portions 20*a* of the cover plate 20 are opposed to the respective openings of the ink inlets 47*a*, 47*b*, 47*c*, 47*d* (see FIGS. 1 and 2).

Figure 5:
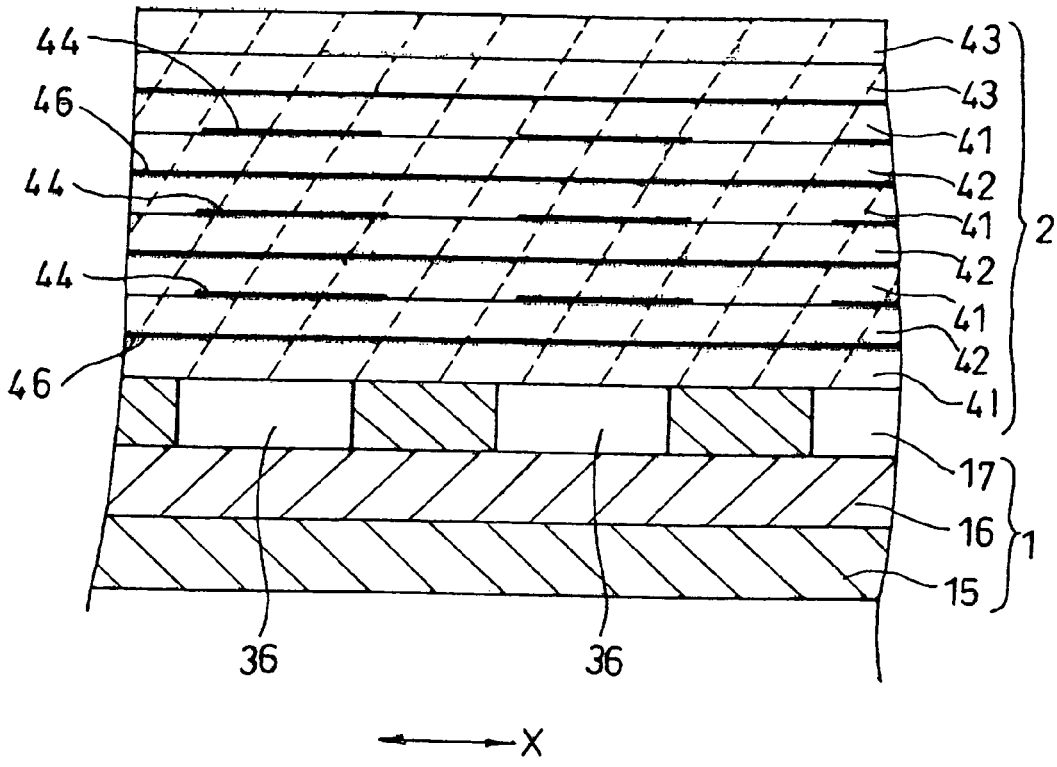
FIG. 5 is a cross sectional view taken along line 5-5 of FIG. 1.

On the other hand, as shown in FIG. 5, the piezoelectric actuator unit 2 is a laminar structure consisting of a plurality of piezoelectric sheets 41-43 (each having a thickness of about 30 μm) superposed on each other, like an actuator unit disclosed in U.S. Pat. No. 5,402,159 (corresponding to JP-H04-341853A). On an upper surface (i.e., surface having a relatively large width) of each of even-numbered ones 42 of the piezoelectric sheets (as counted from the lowermost piezoelectric sheet), there are formed individual electrodes 44 in the form of elongated strips which are aligned with the respective pressure chambers 36 of the cavity unit 1 and which are arranged in five rows parallel to the longitudinal direction of the piezoelectric sheet 42, i.e., the X-axis direction. On an upper surface of each of odd-numbered ones 41 of the piezoelectric sheets (as counted from the lowermost one), there is formed a common electrode 46 which is common to the plurality of pressure chambers 36. On an upper surface of the top sheet, there are formed surface electrodes 48 (see FIG. 1), some of which are electrically connected to the individual electrodes 44, and the other of which are electrically connected to the common electrodes 46.

In the piezoelectric actuator unit 2 constructed as described above, each of piezoelectric sheets has the same number of active portions as that of the pressure chambers 36. Each of the active portions is polarized upon application of a high voltage between the corresponding individual electrode 44 and the common electrode 46, in a known manner. The actuator unit 2 includes a plurality of actuators which are aligned with the respective pressure chambers 36. Each of the plurality of actuators of the actuator unit 2 is provided by corresponding ones of the active portions that are all aligned with the each actuator.

The lower surface of the plate-like piezoelectric actuator unit 2 (i.e., the surface opposed to the pressure chambers 36) is entirely covered by an adhesive sheet (not shown) formed of an ink impermeable synthetic resin, and the piezoelectric actuator unit 2 is then bonded at the adhesive sheet to the upper surface of the cavity unit 1 such that the individual electrodes 44 are aligned with the respective pressure chambers 36 formed in the cavity unit 1. Further, the flexible flat cable 3 is pressed onto the upper surface of the piezoelectric actuator unit 2, such that electrically conductive wires (not shown) of the flat cable 3 are electrically connected to the surface electrodes 48.

Figure 6:
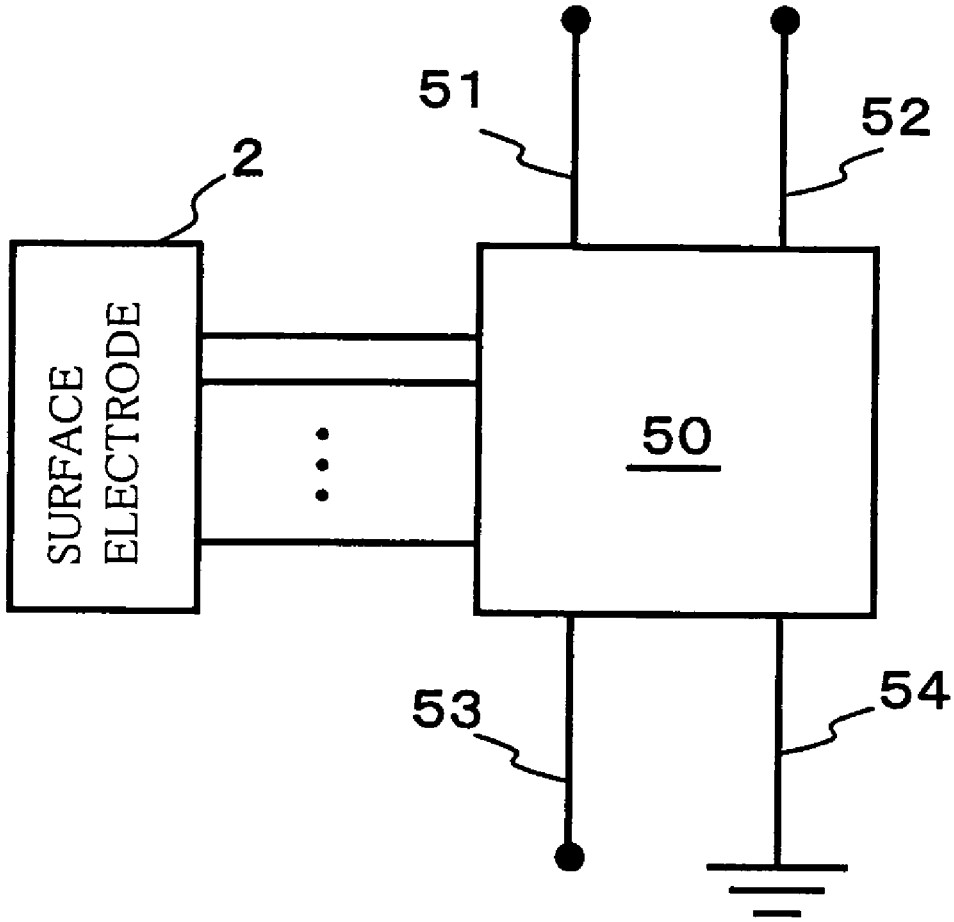
FIG. 6 is a block diagram of a controller.

There will be next described a construction of a controller that is operable to supply a control signal to each of the actuators of the actuator unit 2, with reference to FIG. 6. In the present embodiment, the controller takes the form of a LSI chip 50 that is disposed on the flexible flat cable 3. The LSI chip 50 is electrically connected to the individual and common electrodes 44, 46 via the surface electrodes 48. To the LSI chip 50, there are connected a clock line 51, a data line 52, a voltage line 53 and an earth line 54. The LSI chip 50 is operable to determine, based on clock pulses supplied from the clock line 51 and data supplied from the data line 52, which one or ones of the pressure chambers 36 should be selected as active pressure chamber or chambers from which the ink droplet is to be ejected. The LSI chip 50 controls the actuators corresponding to the selected pressure chambers 36 and also those corresponding to non-selected pressure chambers 36, by controlling a drive voltage that is to be applied to each of the individual electrodes 44. That is, the LSI chip 50 selectively applies the drive voltage (supplied from the voltage line 53) to the individual electrode 44 of each actuator of the actuator unit 2, and connects the individual electrode 44 of each actuator to the earth line 54, depending upon necessity of ejection of the ink droplet from the corresponding pressure chamber 36.

With application of a drive pulse by the controller to the individual electrode 44 of the actuator corresponding to the selected pressure chamber 36, the actuator is deformed or displaced whereby the ejection pressure is applied to the ink stored in the selected pressure chamber 36. The ink droplet is ejected from the nozzle 4, owing to a forward component of the pressure wave propagated from the pressure chamber 36 to the nozzle 4.

The inkjet printer (image forming apparatus) incorporating therein the inkjet head 100 constructed as described above has a plurality of printing modes which are different with respect to resolution and recording speed, like conventional inkjet printers. In the present embodiment, the inkjet printer has, as one of the plurality of printing modes, a low resolution mode in which a printing operation is performed with an image resolution of about 600 dpi×600 dpi (dot per inch). In this low resolution mode, which is employed typically for a text printing, the printing operation is performed by large-sized dots each enabling an ejection volume (ejection capacity) per dot to be about three times as large as a volume of one droplet ejected in a standard resolution mode, for reducing a length of time to complete the printing over a certain unit of area In the present embodiment, each of the large-sized dots is formed by incorporating, in the control signal supplied from the controller to each of the actuators, a drive pulse train including first, second, third and fourth drive pulses P1, P2, P3, P4, as shown in FIG. 7A. The drive pulse train has a waveform consisting of a plurality of first voltage-level regions and a plurality of second voltage-level regions that are alternately arranged. A voltage of the control signal is held in a first level in each of the first voltage-level regions, which causes each actuator to reduce the volume of the corresponding pressure chamber 36. The voltage of the control signal is held in a second level in each of the second voltage-level regions, which causes each actuator to increase the volume of the corresponding pressure chamber 36. Each of the drive pulses P1-P4 is provided by a corresponding one of the second voltage-level region.

In the present embodiment, the voltage of the control signal supplied to the individual electrode 44 of each actuator is held in a predetermined level as the above-described first level, until the corresponding pressure chamber 36 is selected as an active pressure chamber from which an ink ejection is to be caused. The voltage of the control signal is reduced to a ground level (e.g. substantially 0 V) as the above-described second level, when the corresponding pressure chamber 36 is selected as the active pressure chamber. That is, during absence of any command requesting the ink ejection, the predetermined level of the voltage is applied between each of all the individual electrodes 44 and the corresponding common electrode 46, so that the volume of each of all the pressure chambers 36 is held in its reduced state as a result of elongation of each of all the actuators. In response to a command requesting the ink ejection from one of the pressure chambers 36 as the selected pressure chamber, the application of the predetermined level of voltage to the individual electrodes 44 of the actuator corresponding to the selected pressure chamber 36 is suspended, whereby the volume of the selected pressure chamber 36 is placed in its increased state as a result of restoration of the corresponding actuator to its original shape, namely, as a result of contraction of the corresponding actuator. The increase in the volume of the selected pressure chamber 36 causes the ink stored in the selected pressure chamber 36 to be negatively pressurized, whereby a negative pressure wave is generated. Then, the predetermined level of the voltage is applied to the individual electrodes 44 of the corresponding actuator at a point of time at which the pressure of the ink in the selected pressure chamber 36 is inverted from its negative state to positive state. In this instance, the inverted pressure and the pressure caused by the elongation of the corresponding actuator are superimposed on each other, thereby causing the ink ejection from the selected pressure chamber 36 through the nozzle 11 that is held in communication with the selected pressure chamber 36.

A length of time required for transition of the pressure of the ink from negative peak to positive peak is dependent on an one-way propagation time, i.e., a length of time required for a pressure wave to be propagated in an ink channel from the common chamber 7 to the nozzle 4 via the pressure chamber 36. This one-way propagation time is dependent not only on a natural frequency of the ink and a length of the ink channel but also on a resistance acting against the ink flow and a rigidity of the plates defining the ink channel.

That is, where a pulse width of the drive pulse is adjusted to correspond to the above-described one-way propagation time, the pressures are superimposed most effectively, maximizing an ejection velocity and a volume of each ink droplet to be ejected. FIG. 7B is a graph showing a relationship between the pulse width and the ejection characteristic, wherein "T0" denotes a value (hereinafter referred to as "maximizing value") of the pulse width corresponds to the one-way propagation time. As is apparent from an upward convex curved line representative of the relationship, the ejection velocity and the volume of the ink droplet are maximized at the maximizing value T0 and are reduced as the pulse width is deviated from the maximizing value T0 in either of the opposite senses. It is noted that the term "pulse width" used in the present specification is interpreted to mean a leading edge (i.e., a transition from the first voltage-level region to the second voltage-level region) and a trailing edge (i.e., a transition from the second voltage-level region to the first voltage-level region) of the drive pulse.

In the following description, the pulse widths of the first, second, third and fourth drive pulses P1, P2, P3, P4 of the drive pulse train of FIG. 7A are referred to as pulse widths T1, T2, T3 and T4, respectively. A pulse separation between the first and second drive pulses P1, P2, a pulse separation between the second and third drive pulses P2, P3 and a pulse separation between the third and fourth drive pulses P3, P4 are referred to as pulse separations W1, W2 and W3, respectively. It is note that the term "pulse separation" used in the present specification is interpreted to mean a time interval between the trailing edge of one drive pulse and the leading edge of the succeeding drive pulse.

The first and second pulse widths T1, T2 of the first and second drive pulses P1, P2 serving as main drive pulses are both deviated from the maximizing value T0, so that each of ink droplets ejected by the first and second drive pulses P1, P2 has a volume that is smaller than where the ink droplet is ejected by a drive pulse having the pulse width of the maximizing value T0. In the present embodiment, the first pulse width T1 is smaller than the maximizing value T0 while the second pulse width T2 is larger than the maximizing value T0, so that the first and second pulse widths T1, T2 are deviated from the maximizing value T0 in respective opposite senses.

The third and fourth drive pulses P3, P4 serving as complementary drive pulses cause ink ejections, like the first and second drive pulses P1, P2. However, the third and fourth drive pulses P3, P4 are arranged so as not to coincide with crests and troughs of residual pressure waves generated by the first and second drive pulses P1, P2. In other words, the third and fourth drive pulses P3, P4 are arranged such that each of pressure waves generated by the third and fourth drive pulses P3, P4 does not coincide in phase with the pressure waves generated by the first and second drive pulses P1, P2. That is, each of the third and fourth drive pulses P3, P4 causes the ejection of a complementary ink droplet having a volume that is smaller than a main ink droplet ejected by each of the first and second drive pulses P1, P2, and also cancels the residual pressure waves generated by the first and second drive pulses P1, P2. In the present embodiment, the pulse widths T3, T4 are adapted to be smaller than the pulse width T1 and substantially equal to each other.

As discussed above, where a large number of the inkjet heads 100 are manufactured, there is difference among the individual inkjet heads 100 with respect to the ink ejection characteristic. It might be possible to divide the inkjet heads 100 into a plurality of groups based on the ink ejection characteristic, so that different maximizing values T0 are set in the respective different groups of the inkjet heads 100. However, even with such a grouping arrangement, there is inevitably some difference among the inkjet heads 100 in the curved line (representative of the ink ejection characteristic) as shown in FIG. 7B. After all, the inkjet heads 100 would be different from one another in the ink ejection velocity at the maximizing value T0 and also in the maximizing value T0 as such.

In the present embodiment of the invention, however, the first pulse width T1 is set to be smaller than the maximizing value T0 while the second pulse width T2 is set to be larger than the maximizing value T0. That is, since the first and second pulse widths T1, T2 are deviated from the maximizing value T0 in the respective opposite senses, a total volume of the ink droplets ejected by the drive pulses P1, P2 can be substantially constant even if the curved line and the maximizing value T0 are deviated in the horizontal direction in the graph of FIG. 7B. A deviation of the actually maximizing value T0 from its nominal value in the horizontal direction reduces the amount of the ink ejection caused by one of the first and second drive pulses P1, P2 and increases the amount of the ink ejection caused by the other of the first and second drive pulses P1, P2, so that the amounts of the ink ejections caused by the first and second drive pulses P1, P2 are offset by each other.

The third and fourth drive pulses P3, P4 serve as canceling signals to cancel the residual pressure waves so as to reliably prevent occurrence of the satellite droplets, and also serve to complement the required ink ejection amount that corresponds to a total volume of three ink droplets. Since the required ink ejection amount is complemented by the two complementary drive pulses rather than a single complementary drive pulse, the amount of the ink ejection caused by each of the third and fourth drive pulses P3, P4 does not have to be large, namely, each of the third and fourth pulse widths T3, T4 does not have to be set to be large. Since each of the pulse widths T3, T4 may be set to be small, the complementation of the ink ejection amount can be made without deteriorating the canceling effect of the third and fourth drives pulses P3, P4.

In the present embodiment, the drive pulse train incorporated in the control signal for forming the large-sized dot includes the four drive pulses. However, the drive pulse train may additionally include at least one drive pulse following the four dive pulses, as long as the additional drive pulse do not affect a drive cycle for forming the next dot. In this case, the additional drive pulse may be arranged to have a small pulse width so as to serve exclusively as a canceling signal canceling the residual pressure waves without causing additional ink ejection.

Further, the present invention is applicable also to an inkjet printer as disclosed in JP-H09-52357A in which the ink droplet is ejected by shear mode deformation of piezoelectric element of the actuator unit. In this case, the voltage of the control signal supplied to each actuator of the actuator unit is held in the second level (e.g., 0 V), and is raised in the first level causing the volume of the corresponding pressure chamber to be reduced when the corresponding pressure chamber is selected as an active pressure chamber from which the ink ejection is to be caused.

Figure 8:
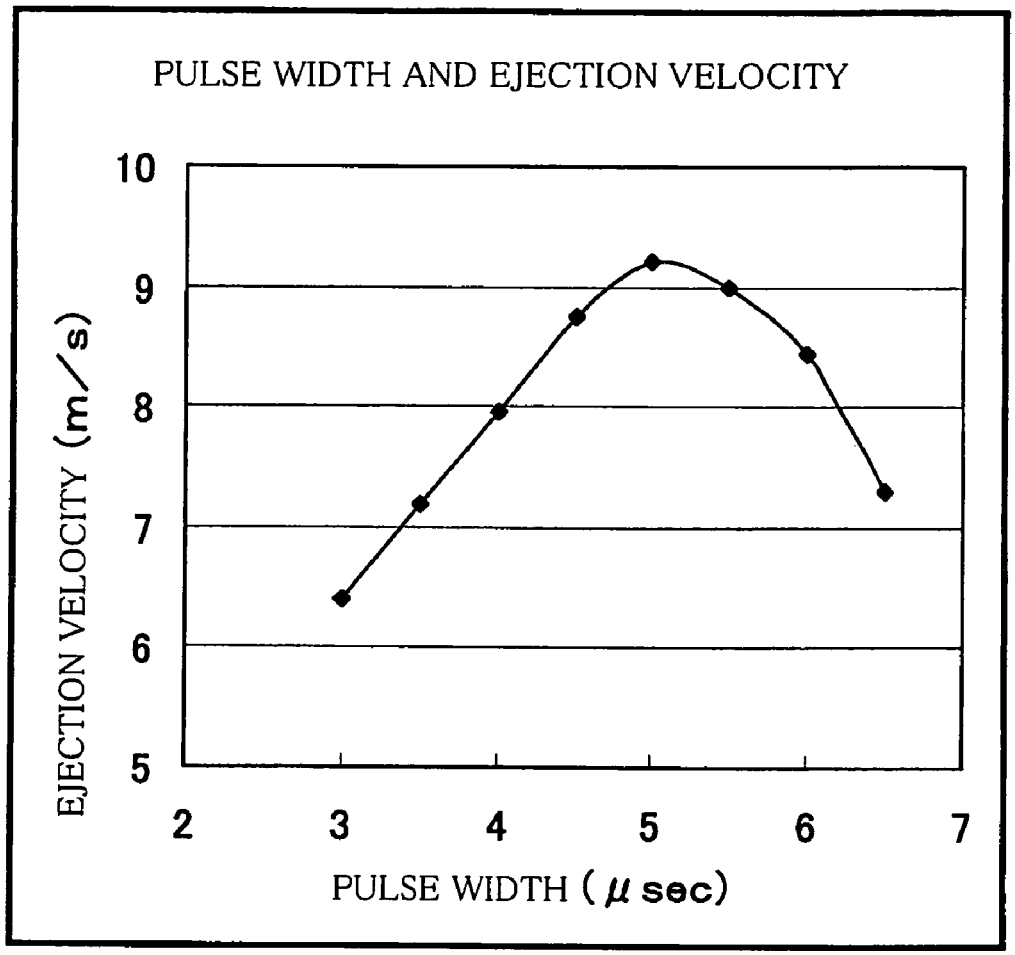
FIG. 8 is graph showing a relationship between the pulse width and the ejection velocity in the inkjet head of FIG. 1.
Figure 10A:
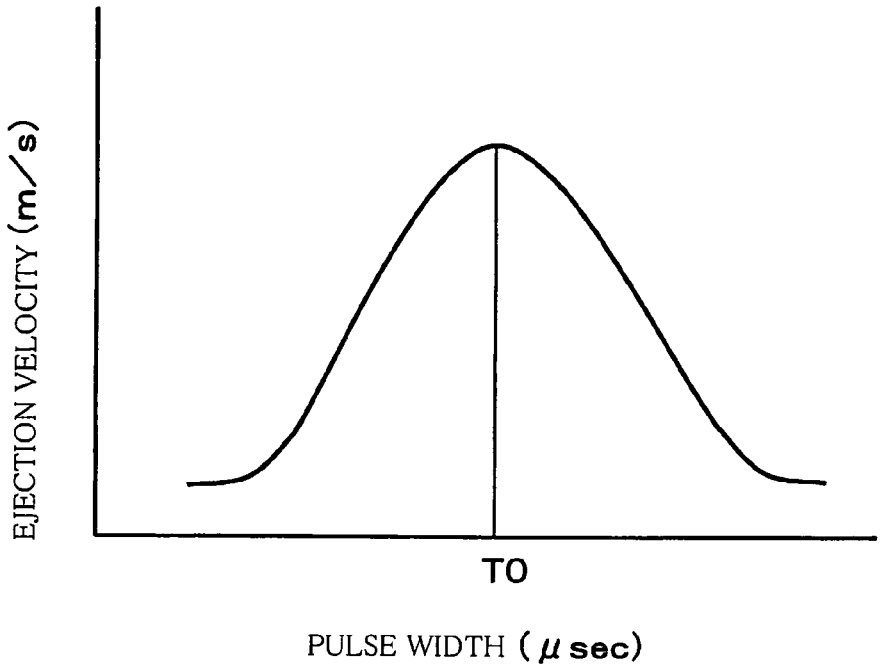
FIG.10A PRIOR ART
FIG. 10A is indicating a conventional pulse width value T0 of each of main drive pulses in a graph showing a relationship between a pulse width of a drive pulse and a velocity of ink droplet ejected by the drive pulse.
Figure 10B:
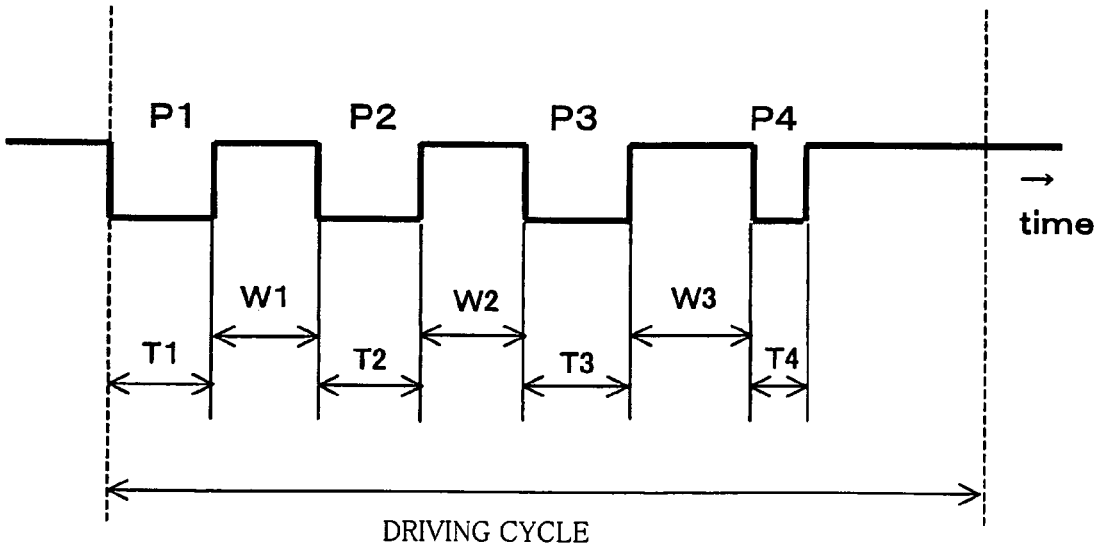
FIG.10B PRIOR ART
FIG. 10B is a view showing a conventional waveform of a pulse train for causing successive ejection of a plurality of ink droplets that cooperate to form one of an image.

An experiment was conducted by the present inventor for obtaining an appropriate combination of values of the above-described first, second, third, fourth drive pulses T1, T2, T3, T4 and first, second, third pulse separations W1, W2, W3, by using a plurality of inkjet heads each of which is provided by the inkjet head 100 constructed as described above. In each of the used inkjet heads, the above-described maximizing value T0 is 5 μsec, as shown in FIG. 8.

In the experiment, the ink ejections were carried out with a total of fifteen combinations (Nos. 1-15) of the values as shown in table of FIG. 9A, and their results were evaluated with respect to four items, i.e., "SATELLITE PREVENTION", "EJECTION STABILITY", "EJECTION CAPACITY" and "DOT SIZE VARIATION". In the item "SATELLITE PREVENTION", it was determined whether the satellite droplets actually appeared in the image produced in the recording medium. In the item "EJECTION STABILITY", it was determined whether the state of ejection of the ink through the nozzle was stable with elapse of time. In the item "EJECTION CAPACITY", it was determined whether a large-sized dot having a desired size was formed on the recording medium. In the item "DOT SIZE VARIATION", it was determined whether there was variation in the size of the formed large-sized dot among the plurality of inkjet heads used in the experiment. The results with respect to the evaluation items are indicated by "○" (excellent), "Δ" (fair) and "×" (poor). It is noted that each of actually set values of the above-described first, second, third, fourth drive pulses T1, T2, T3, T4 and first, second, third pulse separations W1, W2, W3 was not precisely equal to the corresponding nominal value indicated in the table but slightly differed from the nominal value without falling outside the tolerance of ±0.5 μsec.

As is apparent from the table of FIG. 9A, only in two combinations Nos. 2 and 9 (asterisked in the table), excellent results were obtained with respect to all of the four evaluation items. These results revealed that the prevention of the satellite droplets and the formation of the desired large-sized dot can be made without variation in size of the formed dot among the inkjet heads, where the drive pulse train has a waveform that satisfies conditions expressed by the following expressions:

$$3.5\ \mu sec < T1 < 4.5\ \mu sec;\ 3.5\ \mu sec < W1 < 4.5\ \mu sec;$$

$$7.5\ \mu sec < T2 < 8.5\ \mu sec;\ 3.5\ \mu sec < W2 < 5.5\ \mu sec;$$

$$2.5\ \mu sec < T3 < 3.5\ \mu sec;\ 3.5\ \mu sec < W3 < 4.5\ \mu sec;\ \text{and}$$

$$2.5\ \mu sec < T4 < 3.5\ \mu sec.$$

By taking account that the maximizing value T0 was 5 μsec (T0=5 μsec), the above conditions can be expressed also by expressions converted as follows:

$$0.7T0 < T1 < 0.9T0;\ 0.7T0 < W1 < 0.9T0;$$

$$1.5T0 < T2 < 1.7T0;\ 0.7T0 < W2 < 1.1T0;$$

$$0.5T0 < T3 < 0.7T0;\ 0.7T0 < W3 < 0.9T0;\ \text{and}$$

$$0.5T0 < T4 < 0.7T0.$$

Another experiment was conducted by using the inkjet heads in which the maximizing value T0 is 5 μsec, as shown in FIG. 8, with application of the drive pulse trains having conventional waveforms of seven combinations (Nos. 21-27) of the values as shown in table of FIG. 9B. Like in the above-described experiment, it was evaluated with respect to the above-described four items. It is noted that the values T1, T2, T3, W1, W2 were equal to one another (T1=T2=T3=W1=W2) in each of the seven combinations.

As is apparent from the table of FIG. 9B, none of the seven combinations provided excellent results in all of the four evaluation items, where the first, second and third ones (P1, P2, P3) of the four drive pulses have the same pulse width, irrespective of whether the values T1, T2, T3, W1, W2 are equal to or slightly deviated from the maximizing values T0 (5 μsec).

What is claimed is:

1. An ink droplet ejection device comprising:

a plurality of nozzles;

a plurality of pressure chambers held in communication with the respective nozzles;

a plurality of actuators each operable to apply an ejection pressure to an ink stored in a corresponding one of said pressure chambers, for causing an ink ejection from said corresponding one of said pressure chambers through one of said nozzles that is held in communication with said corresponding pressure chamber, whereby an image formed as a result of the ink ejection is produced on a medium; and a controller operable to supply a control signal to each of said plurality of actuators, and incorporating a drive pulse train into said control signal for causing ejection of at least two cooperative ink droplets that cooperate with each other to form one dot of the image produced on the medium, wherein said drive pulse train includes at least two drive pulses, one of said at least two drive pulses having a first pulse width smaller than a maximizing value which is dependent on a length of a propagation time required for a pressure wave to be propagated to each of said nozzles via a corresponding one of said pressure chambers and which maximizes an ejection velocity and a volume of each ink droplet to be ejected, another one of said at least two drive pulses having a second pulse width larger than said maximizing value.

2. The ink droplet ejection device according to claim 1, wherein each of said actuators applies the ejection pressure to the ink stored in the corresponding one of said pressure chambers, by changing a volume of said corresponding pressure chambers, wherein said drive pulse train incorporated in said control signal includes (i) at least one first voltage-level region and (ii) at least one second voltage-level region that are alternatively arranged in said drive pulse train, wherein a voltage of said control signal is held in a first level in said at least one first voltage-level region, which causes each of said actuators to reduce said volume of said corresponding pressure chamber, wherein said voltage of said control signal is held in a second level in said at least one second voltage-level region, which causes each of said actuators to increase said volume of said corresponding pressure chamber, and wherein each of said at least two drive pulses is provided by a corresponding one of said at least one second voltage-level region, and each of said first and second pulse widths corresponds to a time length of a corresponding one of said at least one second voltage-level region.

3. The ink droplet ejection device according to claim 2, wherein said voltage of said control signal supplied from said controller to each of said actuators is held in said first level until said corresponding pressure chamber is selected as an active pressure chamber from which the ink ejection is to be caused, and wherein said voltage of said control signal is placed in said second level when said corresponding pressure chamber is selected as said active pressure chamber.

4. The ink droplet ejection device according to claim 1, wherein said drive pulse train includes, in addition to said at least two drive pulses as at least two main drive pulses, at least one complementary drive pulse following said at least two main drive pulses, for causing ejection of said at least two cooperative ink droplets in the form of at least two main ink droplets and at least one complementary ink droplet each of which has a volume smaller than a volume of each of said at least two main ink droplets.

5. The ink droplet ejection device according to claim 4, wherein each of said at least one complementary drive pulse has a pulse width that is adjusted to cause the volume of each of said at least one complementary ink droplet to be smaller than the volume of each of said at least two main ink droplets and to cancel residual pressure waves generated by said at least two main drive pulses.

6. The ink droplet ejection device according to claim 5, wherein said pulse width of each of said at least one complementary drive pulse is smaller than said first pulse width of said one of said at least two main drive pulses.

7. The ink droplet ejection device according to claim 5, wherein said pulse width of each of said at least one complementary drive pulse is adjusted such that said at least one complementary ink droplet has a total volume that is substantially equal to a difference between a total volume of said at least two main ink droplets and a volume required to form the one dot of the image, said difference being based on difference of said first and second pulse widths from said maximizing value.

8. The ink droplet ejection device according to claim 1, wherein said ink droplet ejection device further has a common ink chamber that is held in communication with said plurality of nozzles via said plurality of pressure chambers, and wherein said maximizing value corresponds to the length of the propagation time required for the pressure wave to be propagated from said common ink chamber to each of said nozzles via a corresponding one of said pressure chambers.

9. An ink droplet ejection device comprising:

a plurality of nozzles;

a plurality of pressure chambers held in communication with the respective nozzles;

a plurality of actuators each operable to apply an ejection pressure to an ink stored in a corresponding one of said pressure chambers, for causing an ink ejection from said corresponding one of said pressure chambers through one of said nozzles that is held in communication with said corresponding pressure chamber, whereby an image formed as a result of the ink ejection is produced on a medium; and a controller operable to supply a control signal to each of said plurality of actuators, and incorporating a drive pulse train into said control signal for causing ejection of at least two cooperative ink droplets that cooperate with each other to form one dot of the image produced on the medium, wherein said drive pulse train includes at least two drive pulses, one of said at least two drive pulses having a first pulse width smaller than a maximizing value that maximizes an ejection velocity and a volume of each ink droplet to be ejected, another one of said at least two drive pulses having a second pulse width larger than said maximizing value, wherein said drive pulse train includes, in addition to said at least two drive pulses as at least two main drive pulses, at least two complementary drive pulses following said at least two main drive pulses, for causing ejection of said at least two cooperative ink droplets in the form of at least two main ink droplets and at least two complementary ink droplets each of which has a volume smaller than a volume of each of said at least two main ink droplets, and wherein said at least two main drive pulses include first and second drive pulses having said first and second pulse widths, respectively, while said at least two complementary drive pulses include third and fourth drive pulses having third and fourth pulse widths, respectively, such that said first, second, third and fourth drive pulses are successively arranged in this order in said drive pulse train.

10. The ink droplet ejection device according to claim 9, wherein all of the drive pulses included in said drive pulse train consist of said first, second, third and fourth drive pulses.

11. The ink droplet ejection device according to claim 9, wherein said first, second, third and fourth pulse widths, a first pulse separation between said first and second pulses, a second pulse separation between said second and third pulses, and a third pulse separation between said third and fourth pulses cooperate to satisfy the following expressions:

$$0.7T0<T1<0.9T0,$$

$$0.7T0<W1<0.9T0,$$

$$1.5T0<T2<1.7T0,$$

$$0.7T0<W2<1.1T0,$$

$$0.5T0<T3<0.7T0,$$

$$0.7T0<W3<0.9T0,$$

$$0.5T0<T4<0.7T0,$$

where "T0" represents said maximizing value; "T1", "T2", "T3", "T4" represent said first, second, third and fourth pulse widths, respectively; and "W1", "W2", "W3" represent said first, second and third pulse separations, respectively.

12. The ink droplet ejection device according to claim 11, wherein said first, second, third and fourth pulse widths, and said first, second and third pulse separations cooperate to satisfy the following expressions:

$$3.5\ \mu sec<T1<4.5\ \mu sec,$$

$$3.5\ \mu sec<W1<4.5\ \mu sec,$$

$$7.5\ \mu sec<T2<8.5\ \mu sec,$$

$$3.5\ \mu sec<W2<5.5\ \mu sec,$$

$$2.5\ \mu sec<T3<3.5\ \mu sec,$$

$$3.5\ \mu sec<W3<4.5\ \mu sec,$$

$$2.5\ \mu sec<T4<3.5\ \mu sec.$$

13. An ink droplet ejection device comprising:

a plurality of nozzles;

a plurality of pressure chambers held in communication with the respective nozzles;

a plurality of actuators each operable to apply an ejection pressure to an ink stored in a corresponding one of said pressure chambers, for causing an ink ejection from said corresponding one of said pressure chambers through one of said nozzles that is held in communication with said corresponding pressure chamber, whereby an image formed as a result of the ink ejection is produced on a medium; and a controller operable to supply a control signal to each of said plurality of actuators, and incorporating a drive pulse train into said control signal for causing ejection of at least two cooperative ink droplets that cooperate with each other to form one dot of the image produced on the medium, wherein said drive pulse train includes at least one main drive pulse and at least one complementary drive pulse following said at least one main drive pulse, for causing ejection of said at least two cooperative ink droplets in the form of at least one main ink droplet and at least one complementary ink droplet each of which has a volume smaller than a volume of each of said at least one main ink droplet, wherein each of said at least one complementary drive pulse has a pulse width that is adjusted to cause the volume of each of said at least one complementary ink droplet to be smaller than the volume of each of said at least one main ink droplet and to cancel a residual pressure wave generated by each of said at least one main drive pulse, and wherein said pulse width of each of said at least one complementary drive pulse is adjusted such that a total volume of said at least one complementary ink droplet is substantially equal to a difference between a total volume of said at least one main ink droplet and a volume required to form the one dot of the image.

14. A method of producing an image on a medium by using the ink droplet ejection device defined in claim 5, comprising:

incorporating said drive pulse train including said at least two main drive pulses and said at least one complementary drive pulse, into said control signal supplied to each of said plurality of actuators, for causing the ejection of said two main ink droplets and said at least one complementary ink droplet that cooperate to form the one dot of the image produced on the medium.

15. The ink droplet ejection device according to claim 13, wherein said pulse width of each of said at least one complementary drive pulse is adjusted such that a volume of each of said at least one complementary ink droplet is small enough to eliminate necessity of a canceling signal following said at least one complementary ink droplet.

16. An ink droplet ejection device comprising:

a plurality of nozzles;

a plurality of pressure chambers held in communication with the respective nozzles;

a plurality of actuators each operable to apply an ejection pressure to an ink stored in a corresponding one of said pressure chambers, for causing an ink ejection from said corresponding one of said pressure chambers through one of said nozzles that is held in communication with said corresponding pressure chamber, whereby an image formed as a result of the ink ejection is produced on a medium; and a controller operable to supply a control signal to each of said plurality of actuators, and incorporating a drive pulse train into said control signal for causing ejection of at least two cooperative ink droplets that cooperate with each other to form one dot of the image produced on the medium, wherein said drive pulse train includes at least two drive pulses, one of said at least two drive pulses having a first pulse width deviated from a maximizing value that maximizes an ejection velocity and a volume of each ink droplet to be ejected, another one of said at least two drive pulses having a second pulse width deviated from said maximizing value, wherein said drive pulse train includes, in addition to said at least two drive pulses as at least two main drive pulses, at least two complementary drive pulses following said at least two main drive pulses, for causing ejection of said at least two cooperative ink droplets in the form of at least two main ink droplets and at least two complementary ink droplets each of which has a volume smaller than a volume of each of said at least two main ink droplets, and wherein said at least two main drive pulses include first and second drive pulses having said first and second pulse widths, respectively, while said at least two complementary drive pulses include third and fourth drive pulses having third and fourth pulse widths, respectively, such that said first, second, third and fourth drive pulses are successively arranged in this order in said drive pulse train.

17. The ink droplet ejection device according to claim 16, wherein each of said third and fourth pulse widths of the respective third and fourth drive pulses as said at least two complementary drive pulses is adjusted to cause the volume of each of said at least two complementary ink droplets to be smaller than the volume of each of said at least two main ink droplets and to cancel residual pressure waves generated by said at least two main drive pulses.

* * * * *